US008840734B2

(12) United States Patent
Miyazaki et al.

(10) Patent No.: US 8,840,734 B2
(45) Date of Patent: Sep. 23, 2014

(54) NON-ORIENTED ELECTRICAL STEEL SHEET

(71) Applicant: Nippon Steel & Sumitomo Metal Corporation, Tokyo (JP)

(72) Inventors: Masafumi Miyazaki, Tokyo (JP); Hideaki Yamamura, Tokyo (JP); Kazuto Kawakami, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 14/115,758

(22) PCT Filed: Feb. 5, 2013

(86) PCT No.: PCT/JP2013/052555

§ 371 (c)(1),
(2), (4) Date: Nov. 5, 2013

(87) PCT Pub. No.: WO2013/121924

PCT Pub. Date: Aug. 22, 2013

(65) Prior Publication Data

US 2014/0072471 A1 Mar. 13, 2014

(30) Foreign Application Priority Data

Feb. 14, 2012 (JP) ..... 2012-029884

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/34*** | (2006.01) |
| ***H01F 1/147*** | (2006.01) |
| ***H01F 1/16*** | (2006.01) |
| ***C21D 6/00*** | (2006.01) |
| ***C22C 38/00*** | (2006.01) |
| ***C22C 38/38*** | (2006.01) |
| ***C22C 38/28*** | (2006.01) |
| ***C22C 38/16*** | (2006.01) |
| ***C22C 38/14*** | (2006.01) |
| ***C21D 8/12*** | (2006.01) |
| ***C22C 38/08*** | (2006.01) |

(52) U.S. Cl.

CPC ..... *C22C 38/38* (2013.01); *C21D 6/005* (2013.01); *C22C 38/04* (2013.01); *C21D 6/008* (2013.01); *C22C 38/002* (2013.01); *C22C 38/004* (2013.01); *C22C 38/28* (2013.01); *C22C 38/001* (2013.01); *C22C 38/02* (2013.01); *C22C 38/16* (2013.01); *C22C 38/14* (2013.01); *C22C 38/008* (2013.01); *C21D 8/12* (2013.01); *C22C 38/08* (2013.01); *H01F 1/16* (2013.01); *C22C 38/34* (2013.01); *C22C 38/005* (2013.01); *C22C 38/06* (2013.01)

USPC ..... 148/309; 148/307; 420/83; 420/118; 420/126

(58) Field of Classification Search

None

See application file for complete search history.

(56) References Cited

U.S. PATENT DOCUMENTS

| | | | |
|---|---|---|---|
| 2006/0243351 | A1 | 11/2006 | Ohashi et al. |
| 2008/0112838 | A1 | 5/2008 | Miyazaki et al. |
| 2009/0202383 | A1 | 8/2009 | Tanaka et al. |
| 2011/0042625 | A1 | 2/2011 | Tanaka et al. |

FOREIGN PATENT DOCUMENTS

| | | | |
|---|---|---|---|
| JP | 54-036966 | | 3/1979 |
| JP | 2005-264280 | A | 9/2005 |
| JP | 2005-336503 | A | 12/2005 |
| JP | 2006-131943 | A | 5/2006 |
| JP | 2006-219692 | A | 8/2006 |
| JP | 2007-016278 | A | 1/2007 |
| JP | 2010-280936 | A | 12/2010 |

OTHER PUBLICATIONS

Hou et al., "Effect of Cerium Content on the Magnetic Properties of Non-oriented Electrical Steels," ISIJ International, 2008, vol. 48, No. 4, pp. 531-539.

International Search Report issued in PCT/JP2013/052555, mailed on Apr. 9, 2013.
Kohno et al., "Effect of REM Addition on Grain Growth Behavior of Non-oriented Electrical Steel Sheets," Current Advances in Materials and Processes—ISIJ, Sep. 1, 2002, vol. 15, No. 6, p. 1207.
Written Opinion issued in PCT/JP2013/052555, mailed on Apr. 9, 2013.

*Primary Examiner* — Deborah Yee
(74) *Attorney, Agent, or Firm* — Birch, Stewart, Kolasch & Birch, LLP

(57) ABSTRACT

A non-oriented electrical steel sheet, containing: C: 0.01 mass % or less; Si: 1.0 mass % or more and 3.5 mass % or less; Al: 0.1 mass % or more and 3.0 mass % or less; Mn: 0.1 mass % or more and 2.0 mass % or less; P: 0.1 mass % or less; S: 0.005 mass % or less; Ti: 0.001 mass % or more and 0.01 mass % or less; N: 0.005 mass % or less; and Y: more than 0.05 mass % and 0.2 mass % or less, with the balance being iron and inevitable impurities.

2 Claims, 1 Drawing Sheet

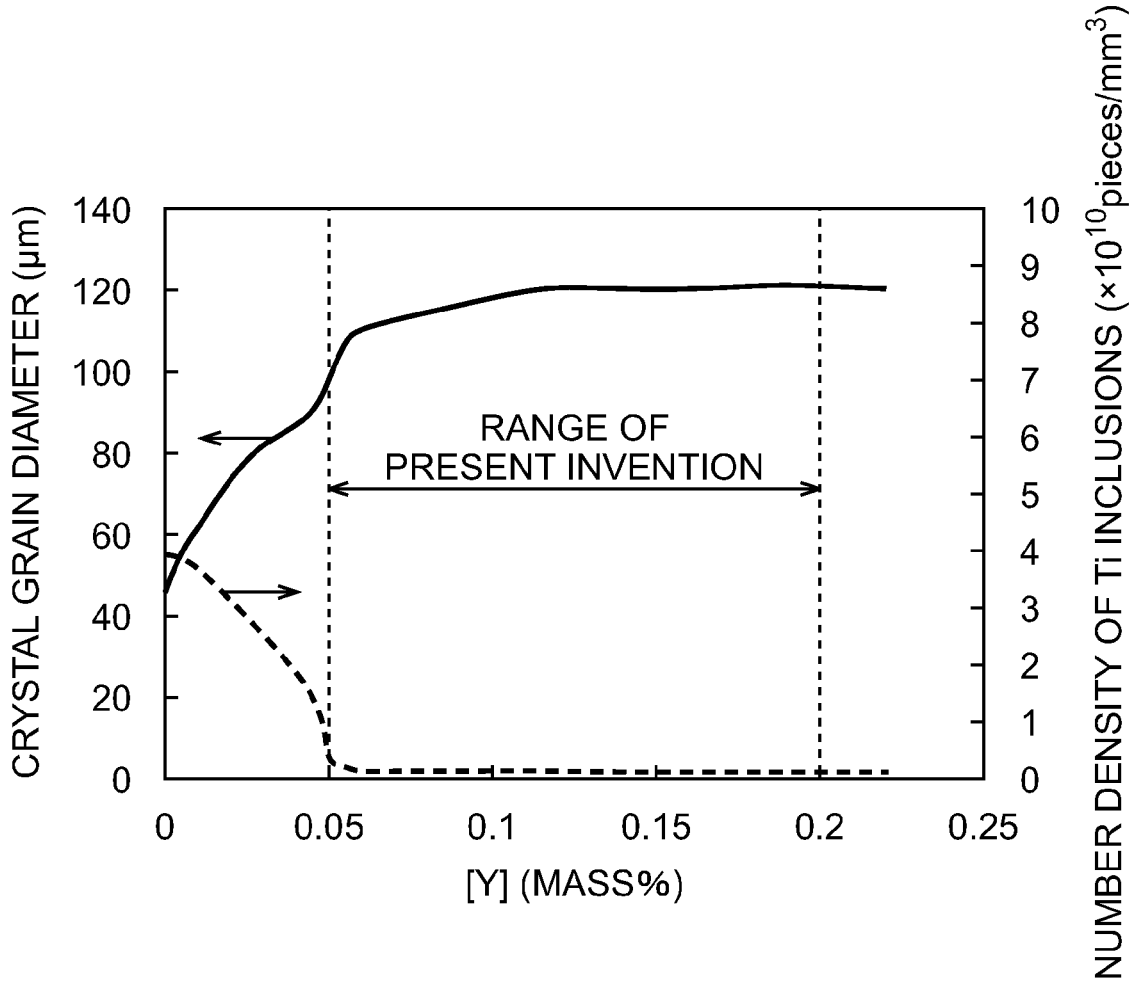
CRYSTAL GRAIN DIAMETER (μm)
140
120
100
80
60
40
20
0
0
0.05
0.1
0.15
0.2
0.25
[Y] (MASS%)
RANGE OF
PRESENT INVENTION
10
9
8
7
6
5
4
3
2
1
0
NUMBER DENSITY OF Ti INCLUSIONS (×10^10 pieces/mm^3)

NON-ORIENTED ELECTRICAL STEEL SHEET

TECHNICAL FIELD

The present invention relates to a high-grade non-oriented electrical steel sheet used for a high-frequency usage such as an iron core of a motor, and to a non-oriented electrical steel sheet to make electric equipment more efficient and contribute to energy saving by reducing energy loss, especially excellent in core loss after a strain relief annealing. This application is based upon and claims the benefit of priority from Japanese Patent Application No. 2012-29884, filed on Feb. 14, 2012; the entire contents of all of which are incorporated herein by reference.

BACKGROUND ART

In recent years, energy saving is required from a point of view of preventing global warming, and further reduction in power consumption is required in fields such as a motor of an air conditioner and a main motor of an electric vehicle. These motors are often used in high rotation, and therefore, improvement in core loss at a region of 400 Hz to 800 Hz being higher frequency than 50 Hz to 60 Hz being a conventional commercial frequency is required for a non-oriented electrical steel sheet (hereinafter, there is a case when it is described as a "steel sheet") to be a motor material.

As a measure to improve the core loss at the high-frequency region of the non-oriented electrical steel sheet, it is generally performed to increase electrical resistance by increasing contents of Si and Al as described in, for example, Patent Literature 1. Note that recently, there is a case when an alloy raw material of Si and Al whose Ti content is high is used as a cheap alloy raw material to reduce cost.

According to the increase of the contents of Si and Al, Ti having high affinity with these elements is inevitably contained in the alloy raw material, and therefore, Ti is inevitably mixed into the steel sheet. When Ti in the steel sheet is 0.001 mass % or more, a number of fine Ti inclusions whose diameters are approximately several dozen nm such as TiN, TiS, TiC are generated in the steel sheet. The fine Ti inclusions in the steel sheet may disturb a growth of crystal grains at an annealing time of the steel sheet, and deteriorates magnetic properties.

Accordingly, it is necessary to reduce the Ti inclusions in the steel sheet as much as possible. One of measures of the above is to use the alloy raw material whose Ti content being an impurity is small. However, there is a problem to incur a cost increase of the alloy raw material if this measure is taken. Besides, it is also one of the measures to reduce the Ti inclusions by decreasing N, S and C in the steel sheet, and it is possible with current technology to enough decrease S and C by a vacuum degassing treatment and so on. However, the treatment for a long time is necessary to decrease S and C in the steel sheet, and productivity is thereby lowered. Besides, it is also conceivable to enhance sealing of a refining vessel not to mix N into molten steel, but it incurs the cost increase caused by the enhancement of the sealing, and further, there is a problem that the mixture of N into the molten steel is inevitable even if the treatment as stated above is performed.

CITATION LIST

Patent Literature

Patent Literature 1: Japanese Laid-open Patent Publication No. 2007-16278

Patent Literature 2: Japanese Laid-open Patent Publication No. 2005-336503

Patent Literature 3: Japanese Examined Patent Application Publication No. 54-36966

Patent Literature 4: Japanese Laid-open Patent Publication No. 2006-219692

SUMMARY OF INVENTION

Technical Problem

An object of the present invention is to provide a non-oriented electrical steel sheet capable of being manufactured with low cost and high productivity by a manufacturing process in conventional means, and excellent in crystal grain growth potential at an annealing time and whose core loss at high-frequency is good.

Solution to Problem

The gist of the present invention to solve the above-stated problems is as described below.

(1) A non-oriented electrical steel sheet, containing:

C: 0.01 mass % or less,

Si: 1.0 mass % or more and 3.5 mass % or less,

Al: 0.1 mass % or more and 3.0 mass % or less,

Mn: 0.1 mass % or more and 2.0 mass % or less,

P: 0.1 mass % or less,

S: 0.005 mass % or less,

Ti: 0.001 mass % or more and 0.01 mass % or less,

N: 0.005 mass % or less, and

Y: more than 0.05 mass % and 0.2 mass % or less, with a balance being iron and inevitable impurities.

(2) The non-oriented electrical steel sheet according to (1), further containing elements of group(s) of one type or two types or more selected from:

a first group of one type or two types selected from a group consisting of Cu: 0.5 mass % or less, and Cr: 20 mass % or less;

a second group of one type or two types selected from a group consisting of Sn and Sb for a total of 0.3 mass % or less;

a third group of Ni: 1.0 mass % or less; and a fourth group of Ca: 0.01 mass % or less.

Advantageous Effects of Invention

The non-oriented electrical steel sheet according to the present invention is excellent in the crystal grain growth potential at the annealing time and the core loss at the high-frequency region because the amount of fine Ti inclusions in the steel sheet is small. Further, it is possible to manufacture with low cost and high productivity, and therefore, it is possible to contribute to energy saving by improving motor characteristics.

BRIEF DESCRIPTION OF DRAWINGS

FIG. 1 is a view illustrating a relationship among a Y content in a steel sheet, a content of Ti inclusions of a production sample after a strain relief annealing, and a crystal grain diameter.

DESCRIPTION OF EMBODIMENTS

When a proper amount of Y is added to a non-oriented electrical steel sheet, generation of Ti inclusions such as fine TiN, TiS, TiC in the steel sheet is suppressed, and a number density of these Ti inclusions remarkably decreases. It becomes clear as a result of hard examinations that suppression of a crystal grain growth of steel is thereby released and a crystal grain growth potential is largely improved. Note that Y represents yttrium, being an element having atomic number 39, and is a kind of a rare-earth element.

Hereinafter, effects to add Y are described in detail.

A laboratory experiment using a vacuum melting is performed by the following procedure. At first, various kinds of molten steels containing C: 0.0019 mass % to 0.0032 mass %, Si: 2.7 mass % to 3.1 mass %, Al: 0.2 mass % to 0.46 mass %, Mn: 0.3 mass % to 0.5 mass %, P: 0.03 mass % to 0.05 mass %, S: 0.0022 mass % to 0.0035 mass %, Ti: 0.002 mass % to 0.005 mass %, and N: 0.0018 mass % to 0.0033 mass % as basic components, and changing a component within a range of Y: "0" (zero) mass % to 0.25 mass % are melted. Each of them is solidified into an ingot, and thereafter, experiments are performed in a sequence of a hot rolling, a hot-rolled sheet annealing, a cold rolling, a finish annealing, and a strain relief annealing as the laboratory experiment to manufacture a production sample whose thickness is 0.35 mm. Next, examinations of inclusions and crystal grains are performed by the following methods.

At first, an examination method of the inclusions is described. The sample is first polished from a surface thereof to an appropriate thickness to make the surface of the sample a mirror surface. After a later-described etching is performed, the inclusions are examined by using a field-emission type scanning electron microscope and an energy dispersive spectroscopic analyzer. In this examination, a composition of the inclusion is analyzed and the number of inclusions in a unit observation area is counted as for the inclusions whose diameters are 10 nm to 500 nm. It is converted into a number density of the inclusions per unit volume of the sample according to a formula of DeHoff illustrated in ASTM E127: Annual Book of ASTM standards Vol. 03.03, (1995). Note that the above-stated method is an example, and a replica or a thin film may be created from the sample to examine, or a transmission electron microscope may be used.

As an etching method, for example, a method of Kurosawa, and so on described in (Fumio Kurosawa, Isao Taguchi, Ryutaro Matsumoto: The Journal of the Japan Institute of Metals, 43 (1979), p. 1068) is used. Electrolytic etching is performed for the sample in non-water-soluble solvent liquid according to this method, and the inclusions are extracted by dissolving only the steel while remaining the inclusions. Besides, when the crystal grain diameter is measured, a cross section of the sample is mirror polished, nital etching is performed to exhibit the crystal grain, and an average crystal grain diameter is measured.

FIG. 1 is a view illustrating a relationship among an Y content, an amount of Ti inclusions, and the crystal grain diameter in a production sample according to the above-stated experiment. Note that in FIG. 1, a relationship between the Y content and the amount of the Ti inclusions is represented by a dotted line, and a relationship between the Y content and the crystal grain diameter is represented by a solid line. Here, there are TiN, TiS and TiC in kinds of the observed Ti inclusions. These Ti inclusions are each different in a temperature in which they are generated, where TiN is generated at 1000° C. or more, TiS is generated at 900° C. or more and less than 1000° C., and TiC is generated at 700° C. or more and 800° C. or less. These Ti inclusions are generated a lot as fine inclusions whose diameters are approximately several dozen nm while generally using a grain boundary, dislocation, and so on as a precipitation site, and disturb a growth of the crystal grain of the steel by pinning it.

As a result of the experiment, it becomes obvious that when more than 0.05 mass % of Y is contained in the steel sheet, the number density of the Ti inclusions in the production sample remarkably decreases and growth potential of the crystal grain of the steel is drastically improved.

Here, when Y is added, Y inclusions of an Y oxide and an Y oxysulfide whose diameters are several hundred nm are observed in the steel sheet, but an amount of Y existing as the Y inclusions as stated above does not exceed 0.01 mass %. Accordingly, when Y is added for more than 0.01 mass %, it is estimated that Y is solid-dissolved in the steel sheet. As the Y content in the steel sheet exceeds 0.01 mass % and the amount of Y estimated to be solid-dissolved increases, the number density of the Ti inclusions decreases monotonously. When the Y content in the steel sheet exceeds 0.05 mass %, it becomes obvious that the number density of the Ti inclusions in the steel sheet becomes remarkably small. Note that a mechanism in which the Ti inclusions are suppressed by Y is not clear, but it is conceivable that when Y is solid-dissolved in the steel sheet, an activity of Ti in the steel sheet decreases and the generation of the Ti inclusions is suppressed. Note that this effect is peculiar to Y, and the effect as stated above cannot be seen in the other rare-earth elements.

It is observed that a required range of the Y content in the steel sheet is more than 0.05 mass % from the above-stated experiment to remarkably decrease the Ti inclusions. On the other hand, when the Y content in the production sample exceeds 0.2 mass %, segregation of Y at the grain boundary becomes remarkable, the grain boundary is embrittled, and scabs occur at a surface of the production sample.

Accordingly, it is important to suppress a grain boundary segregation of Y by setting the Y content in the steel sheet at 0.2 mass % or less while enough suppressing the Ti precipitate by making the steel sheet contain Y more than 0.05 mass % so as to manufacture a non-oriented electrical steel sheet whose crystal grain growth potential is good, magnetic properties are good, and a surface quality thereof is also good.

The above-stated effects of Y incur the suppression of the Ti inclusions in the steel sheet, namely, it contributes to suppress the generation of TiN, TiS, and so on at a hot-rolled sheet annealing or a cold-rolled sheet finish annealing, and to suppress the generation of TiC at a strain relief annealing time.

Next, limitation reasons of components in the present invention are described.

[C]

C not only deteriorates the magnetic properties by forming TiC in the steel sheet but also makes magnetic aging remarkable by a precipitation of C, and therefore, an upper limit of a C content is set at 0.01 mass %. A lower limit of the C content is not particularly limited because it is more preferable as it is smaller, and "0" (zero) mass % may be included.

[Si]

Si is an element decreasing the core loss. It is impossible to enough decrease the core loss when an Si content is smaller than 1.0 mass % being a lower limit. Note that the lower limit of the Si content is preferably 1.5 mass %, more preferably 2.0 mass % from a point of view of further decreasing the core loss. Besides, when the Si content exceeds 3.5 mass % being an upper limit thereof, processability becomes remarkably bad, so the upper limit is set at 3.5 mass %. Note that a more preferable value as the upper limit of the Si content is 3.3 mass % by which processability at the cold rolling becomes better, further preferable value is 3.1 mass %, and still further preferable value is 3.0 mass %.

[Al]

Al is an element decreasing the core loss similar to Si. It is impossible to enough decrease the core loss when an Al content is smaller than 0.1 mass % being a lower limit. Besides, when the Al content exceeds 3.0 mass % being an upper limit thereof, the cost increase is remarkable. Therefore, the lower limit of the Al content is preferably 0.2 mass %, more preferably 0.3 mass %, and further preferably 0.4 mass % from a point of view of the core loss. Besides, the upper limit of the Al content is preferably 2.5 mass %, more preferably 2.0 mass %, and further preferably 1.8 mass % from a point of view of the cost.

[Mn]

Mn increases hardness of the steel sheet and improves a punching property thereof, and therefore, Mn is added for 0.1 mass % or more. Note that a reason why an upper limit of an Mn content is set at 2.0 mass % is for an economical reason.

[P]

P increases strength of a material and improves the processability, and therefore, P is contained. Note that the processability at the cold rolling is lowered when P is excessively contained, and therefore, a P content is set to be 0.1 mass % or less. Incidentally, a lower limit of the P content is not provided because P is inevitably mixed during a manufacturing process of the steel sheet, but in general, it is preferable not to set the P content at less than 0.0001 mass % from a point of view of a steelmaking cost.

[Y]

Y acts on Ti in the steel sheet in a solid-dissolved state to suppress the generation of the Ti inclusions. The effect can be obtained when a Y content exceeds 0.05 mass %. Besides, the more the amount of the Y content is, the clearer the effect becomes, and therefore, it is preferably 0.055 mass % or more, and more preferably 0.06 mass % or more. Incidentally, when the Y content becomes excessive, Y segregates at the grain boundary in the steel sheet, the grain boundary is embrittled, and deterioration of a production quality is incurred caused by generation of scabs and so on. Accordingly, there is an upper limit in the Y content, and the segregation of Y at the grain boundary is suppressed when the Y content is 0.2 mass % or less. The upper limit value of the Y content is preferably 0.15 mass %, and more preferably 0.12 mass %.

[S]

S becomes a sulfide such as TiS and MnS, deteriorates the crystal grain growth potential, and deteriorates the core loss. An upper limit of an S content to prevent the above is 0.005 mass %, and a more preferable upper limit is 0.003 mass %. A lower limit of the S content is not particularly limited because the smaller the S content is, the more preferable it is and "0" (zero) mass % may be included.

[N]

N becomes a nitride such as TiN and deteriorates the core loss, and therefore, an allowable upper limit of an N content is set at 0.005 mass %. Note that the upper limit of the N content is preferably 0.003 mass %, more preferably 0.0025 mass %, and further preferably 0.002 mass %. Besides, it is preferable that an amount of N is smaller as much as possible from a point of view of suppressing the generation of the nitride. Accordingly, a lower limit of the N content is not particularly limited, but there is a lot of industrial restriction if the N content is tried to approximate to "0" (zero) mass % as much as possible, and therefore, it is preferable to set the lower limit of the N content to be more than "0" (zero) mass %. Note that an aim of the lower limit of the N content is 0.001 mass % within a range capable of performing denitrification in an industrial manufacturing process. Further, when the denitrification is ultimately performed, it is more preferable when the N content is lowered to 0.0005 mass % because the generation of the nitride is further suppressed.

[Ti]

Ti generates fine inclusions such as TiN, TiS, TiC, deteriorates the crystal grain growth potential, and deteriorates the core loss. The generation of the Ti inclusions is suppressed by the present invention, but an allowable upper limit of a Ti content is set at 0.01 mass %. Besides, the upper limit is preferably 0.005 mass % from the above-stated reason. Note that when the Ti content is lower than 0.001 mass %, an amount of Ti precipitate becomes too small, and a disturbing effect of the crystal grain growth becomes substantially no problem. On the other hand, an alloy material whose Ti content is less than 0.001 mass % is expensive, and therefore, it leads to the cost increase. Accordingly, it is allowable up to 0.001 mass % in which Ti is inevitably mixed to as an impurity as a lower limit in which the suppression of the generation of the Ti inclusions according to the present invention is required. Note that there is a case when Ti is contained in an alloy material for 0.002 mass % or more when a particularly cheap alloy material is used, and the present technology is especially effective in such a case.

Elements other than the above-described components may be contained as long as the effect is not largely disturbed, and they are also within a range of the present invention. Hereinafter, selected elements are described. Note that lower limit values of these contents are all set to be more than "0" (zero) mass % because it is good as long as they are contained only for a very small amount.

[Cu]

Cu improves corrosion resistance, increases specific resistance, and improves the core loss. Note that when a Cu content is excessive, scabs and so on are generated at a surface of a product sheet to damage a surface quality, and therefore, the Cu content is preferably 0.5 mass % or less.

[Cr]

Cr improves the corrosion resistance, increases the specific resistance, and improves the core loss. Note that when Cr is excessively added, the cost increases, and therefore, an upper limit of a Cr content is preferably set at 20 mass %.

[Sn] and [Sb]

Sn and Sb are segregation elements and improve the magnetic properties by disturbing an aggregate structure on a (111) plane which deteriorates the magnetic properties. The above-stated effect is exhibited by using only one kind of these elements, or two kinds in combination. Note that when a total amount of Sn and Sb exceeds 0.3 mass %, the processability at the cold rolling deteriorates, and therefore, it is preferable that an upper limit of the total of Sn and Sb is set at 0.3 mass %.

[Ni]

Ni develops the aggregate structure advantageous for the magnetic properties to improve the core loss. Note that when Ni is excessively added, the cost increases, and therefore, an upper limit of an Ni content is preferably set at 1.0 mass %.

[Ca]

Ca is a desulfurizing element, fixes S in the steel sheet, and prevents or suppresses the generation of sulfide inclusions such as TiS and MnS. Incidentally, when a Ca content exceeds 0.01 mass %, it is not preferable because problems such as erosion of refractory occurs, and therefore, an upper limit of the Ca content is preferably set at 0.01 mass %.

Note that there is a case when, for example, the following elements are contained as inevitable impurities, but there is no problem as long as each of them is within a range described below.

[Zr]

Even a very small amount of Zr disturbs the crystal grain growth, and deteriorates the core loss after the strain relief annealing. When it is reduced as much as possible, a Zr content generally becomes 0.01 mass % or less, and when the Zr content is within this range, there is no adverse effect and no problem.

[V]

V forms the nitride or a carbide, and disturbs a drain wall displacement and the crystal grain growth. When it is reduced as much as possible, a V content generally becomes 0.01 mass % or less, and when the V content is within this range, there is no adverse effect and no problem.

[Nb]

Nb forms the nitride or the carbide, and disturbs the drain wall displacement and the crystal grain growth. When it is reduced as much as possible, an Nb content generally becomes 0.01 mass % or less, and when the Nb content is within this range, there is no adverse effect and no problem.

[Mg]

Mg is the desulfurizing element, forms a sulfide by reacting with S in the steel sheet, and fixes S. As an Mg content increases, a desulfurizing effect is enhanced, but when the Mg content exceeds 0.05 mass %, the crystal grain growth is disturbed by an excessive Mg sulfide. Generally, the Mg content is 0.05 mass % or less, and when the Mg content is within this range, there is no adverse effect and no problem.

[O]

An oxide is formed by O in the steel sheet. Incidentally, in the present invention, Al is contained for 0.1 mass % or more, and it is enough deoxidized, and therefore, an O content in the steel sheet is 0.005 mass % or less. When the O content is within this range, there is no adverse effect such as the disturbance of the drain wall displacement and the crystal grain growth caused by the oxide and no problem.

[B]

B is a grain boundary segregation element, and forms the nitride. A grain boundary migration is disturbed by the nitride, and the core loss is deteriorated. When B is reduced as much as possible, a B content generally becomes 0.005 mass % or less, and when the B content is within this range, there is no adverse effect and no problem.

Next, a manufacturing method of the non-oriented electrical steel sheet according to the present invention is described. In a steelmaking stage, refining is performed according to a conventional procedure such as a converter and a secondary refining furnace, and it is produced into a desired composition range. After that, a cast slab such as a slab is casted by a continuous casting or an ingot casting. After this, the obtained cast slab is hot rolled, and a hot-rolled sheet annealing is performed for a hot-rolled sheet within a range of 1100° C. to 1300° C. according to need. Next, it is finished into a production thickness by one time cold-rolling or two times or more of cold-rollings with an intermediate annealing at 850° C. to 1000° C. inbetween. Next, a finish annealing is performed within a range of 800° C. to 1100° C., an insulating film is coated thereon to obtain a product. Besides, the strain relief annealing is performed within a range of 700° C. to 800° C. according to circumstances.

As described above, according to the present invention, it is possible to suppress the number density of the Ti inclusions in the steel sheet into $0.3\times10^{10}$ pieces/mm$^3$ or less, preferably $0.2\times10^{10}$ pieces/mm$^3$ or less, and more preferably $0.1\times10^{10}$ pieces/mm$^3$ or less without changing the manufacturing process. Accordingly, it is possible to manufacture the non-oriented electrical steel sheet whose crystal grain growth potential is good.

EXAMPLE

Hereinafter, effects of the present invention are described based on examples. Note that conditions and so on in these experiments are just examples applied to verity operational possibility and effects of the present invention, and the present invention is not limited to these examples.

At first, a steel having components containing: C: 0.0015 mass %, Si: 2.9 mass %, Mn: 0.5 mass %; P: 0.09 mass %; S: 0.002 mass %; Al: 0.43 mass %, and N: 0.0022 mass %, and containing various kinds of elements as represented in Table 1, with the balance made up of iron and inevitable impurities was prepared. Then the steel having the above-stated components was refined by the converter and a vacuum degassing device, the steel was received by a ladle, passing through a tundish, a molten steel was supplied into a mold by an immersion nozzle, it was continuously casted to obtain a cast slab. Note that when Y was contained, a metal Y was added in a vacuum degassing tank. After that, the cast slab was hot rolled, the hot-rolled sheet annealing was performed for the obtained hot-rolled sheet at 1150° C., and it was cold-rolled to be a thickness of 0.35 mm. Then the finish annealing was performed at 950° C. for 30 seconds, the insulating film was coated to be a product, further the strain relief annealing was performed at 750° C. for two hours.

The precipitate and the crystal grain diameter of the product sheet were examined by the above-stated methods, and the core loss of the product sheet was examined by an Epstein method illustrated in JIS-C-2550 by cutting the product sheet into 25 cm long. Examination results are also illustrated in Table 1.

TABLE 1

| | COMPONENT VALUE (MASS %) | | | | | | | | |
|---|---|---|---|---|---|---|---|---|---|
| No. | [Ti] | [Y] | [Cr] | [Cu] | [Sn] | [Sb] | [Ni] | [Ca] | RARE-EARTH ELEMENT OTHER THAN [Y] |
| 1 | 0.0023 | 0.000 | — | 0 | 0 | 0 | 0 | 0 | 0 |
| 2 | 0.0023 | 0.005 | 0 | 0 | 0 | 0 | 0 | 0 | 0 |
| 3 | 0.0023 | 0.009 | 0 | 0 | 0 | 0 | 0 | 0 | 0 |
| 4 | 0.0023 | 0.025 | 0 | 0 | 0 | 0 | 0 | 0 | 0 |
| 5 | 0.0023 | 0.045 | 0 | 0 | 0 | 0 | 0 | 0 | 0 |
| 6 | 0.0023 | 0.051 | 0 | 0 | 0 | 0 | 0 | 0 | 0 |
| 7 | 0.0023 | 0.056 | 0 | 0 | 0 | 0 | 0 | 0 | 0 |
| 8 | 0.0023 | 0.056 | 1.8 | 0 | 0 | 0 | 0 | 0 | 0 |
| 9 | 0.0023 | 0.056 | 0 | 0.14 | 0 | 0 | 0 | 0 | 0 |
| 10 | 0.0023 | 0.056 | 0 | 0 | 0.08 | 0 | 0 | 0 | 0 |
| 11 | 0.0023 | 0.056 | 0 | 0 | 0 | 0.1 | 0 | 0 | 0 |

TABLE 1-continued

| | | | | | | | | | |
|---|---|---|---|---|---|---|---|---|---|
| 12 | 0.0023 | 0.056 | 0 | 0 | 0 | 0 | 0.45 | 0 | 0 |
| 13 | 0.0023 | 0.056 | 0 | 0 | 0 | 0 | 0 | 0.002 | 0 |
| 14 | 0.0023 | 0.060 | 0 | 0 | 0 | 0 | 0 | 0 | 0 |
| 15 | 0.0023 | 0.080 | 0 | 0 | 0 | 0 | 0 | 0 | 0 |
| 16 | 0.0011 | 0.080 | 0 | 0 | 0 | 0 | 0 | 0 | 0 |
| 17 | 0.0023 | 0.115 | 0 | 0 | 0 | 0 | 0 | 0 | 0 |
| 18 | 0.0095 | 0.125 | 0 | 0 | 0 | 0 | 0 | 0 | 0 |
| 19 | 0.0023 | 0.140 | 0 | 0 | 0 | 0 | 0 | 0 | 0 |
| 20 | 0.0023 | 0.160 | 0 | 0 | 0 | 0 | 0 | 0 | 0 |
| 21 | 0.0023 | 0.190 | 0 | 0 | 0 | 0 | 0 | 0 | 0 |
| 22 | 0.0023 | 0.220 | 0 | 0 | 0 | 0 | 0 | 0 | 0 |
| 23 | 0.0120 | 0.080 | 0 | 0 | 0 | 0 | 0 | 0 | 0 |
| 24 | 0.0011 | 0.000 | 0 | 0 | 0 | 0 | 0 | 0 | La = 0.055 |
| 25 | 0.0023 | 0.000 | 0 | 0 | 0 | 0 | 0 | 0 | Ce = 0.080 |

| | CHARACTERISTICS, MATERIALS, QUALITY OF PRODUCT SHEET | | | | |
|---|---|---|---|---|---|
| No. | NUMBER OF Ti INCLUSIONS PER UNIT VOLUME OF STEEL ($\times 10^{10}$ pieces/mm$^3$) ※1 | CRYSTAL GRAIN DIAMETER (μm) | CORE LOSS W10/800 (W/kg) | PRESENCE/ ABSENCE OF SURFACE SCABS | REMARKS |
| 1 | 4.0 | 55 | 61.3 | ABSENT | COMPARATIVE EXAMPLE |
| 2 | 3.8 | 65 | 59.5 | ABSENT | COMPARATIVE EXAMPLE |
| 3 | 3.7 | 70 | 59.4 | ABSENT | COMPARATIVE EXAMPLE |
| 4 | 2.9 | 80 | 58.3 | ABSENT | COMPARATIVE EXAMPLE |
| 5 | 1.4 | 85 | 57.7 | ABSENT | COMPARATIVE EXAMPLE |
| 6 | 0.3 | 100 | 54.3 | ABSENT | EXAMPLE OF PRESENT INVENTION |
| 7 | 0.2 | 105 | 53.1 | ABSENT | EXAMPLE OF PRESENT INVENTION |
| 8 | 0.2 | 105 | 52.9 | ABSENT | EXAMPLE OF PRESENT INVENTION |
| 9 | 0.2 | 110 | 53.3 | ABSENT | EXAMPLE OF PRESENT INVENTION |
| 10 | 0.2 | 115 | 53.3 | ABSENT | EXAMPLE OF PRESENT INVENTION |
| 11 | 0.2 | 110 | 53.1 | ABSENT | EXAMPLE OF PRESENT INVENTION |
| 12 | 0.2 | 110 | 53.2 | ABSENT | EXAMPLE OF PRESENT INVENTION |
| 13 | 0.2 | 110 | 52.8 | ABSENT | EXAMPLE OF PRESENT INVENTION |
| 14 | 0.1 | 115 | 53.2 | ABSENT | EXAMPLE OF PRESENT INVENTION |
| 15 | 0.2 | 125 | 53.1 | ABSENT | EXAMPLE OF PRESENT INVENTION |
| 16 | 0.1 | 130 | 52.8 | ABSENT | EXAMPLE OF PRESENT INVENTION |
| 17 | 0.1 | 115 | 53.3 | ABSENT | EXAMPLE OF PRESENT INVENTION |
| 18 | 0.1 | 110 | 53.5 | ABSENT | EXAMPLE OF PRESENT INVENTION |
| 19 | 0.1 | 120 | 53.3 | ABSENT | EXAMPLE OF PRESENT INVENTION |
| 20 | 0.1 | 120 | 53.1 | ABSENT | EXAMPLE OF PRESENT INVENTION |
| 21 | 0.1 | 120 | 53.0 | ABSENT | EXAMPLE OF PRESENT INVENTION |
| 22 | 0.1 | 115 | 53.4 | PRESENT | COMPARATIVE EXAMPLE |
| 23 | 0.8 | 75 | 59.6 | ABSENT | COMPARATIVE EXAMPLE |
| 24 | 2.8 | 80 | 58.6 | ABSENT | COMPARATIVE EXAMPLE |
| 25 | 2.1 | 70 | 59.3 | ABSENT | COMPARATIVE EXAMPLE |

※1 TOTAL OF TiN, TiS, TiC

As illustrated in Table 1, the number of Ti inclusions (number density) such as TiN, TiS and TiC in the product sheet was $0.3\times10^{10}$ pieces/mm$^3$ or less in each of No. 6 to No. 21 being the present invention's examples. Besides, the crystal grain diameters of these samples were each 100 μm or more, and the crystal grain growth potentials were fine, and the core loss values were good relative to comparative examples except No. 22.

On the other hand, the Y content in each of No. 1 to No. 5 being the comparative examples was lower than the lower limit in the range of more than 0.05 mass % to 0.2 mass % or less, besides, the Ti content in No. 23 being the comparative example was higher than the upper limit in the range of 0.001 mass % or more and 0.01 mass % or less. Further, a rare-earth element other than Y was used instead of Y in No. 24, No. 25 being the comparative examples. In all of these comparative examples, a number of Ti inclusions such as TiN, TiS and TiC were generated in the product sheet, and the crystal grain growth potential and the core loss value were deteriorated compared to the present examples. Besides, the Y content in No. 22 being the comparative example was higher than the upper limit in the range of more than 0.05 mass % to 0.2 mass % or less, therefore in No. 22 being the comparative example, the segregation of Y appeared at the grain boundary of the product sheet, scabs were generated at the surface of the product sheet, and the surface quality was deteriorated.

INDUSTRIAL APPLICABILITY

As described above, it becomes possible to obtain fine magnetic properties and to contribute to energy saving while satisfying needs of customers by enough suppressing precipitation of TiN, TiS and TiC contained in the non-oriented electrical steel sheet.

The invention claimed is:

1. A non-oriented electrical steel sheet, containing:

C: 0.01 mass % or less;

Si: 1.0 mass % or more and 3.5 mass % or less;

Al: 0.1 mass % or more and 3.0 mass % or less;

Mn: 0.1 mass % or more and 2.0 mass % or less;

P: 0.1 mass % or less;

S: 0.005 mass % or less;

Ti: 0.001 mass % or more and 0.01 mass % or less;

N: 0.005 mass % or less; and

Y: more than 0.05 mass % and 0.2 mass % or less, with a balance being iron and inevitable impurities.

2. The non-oriented electrical steel sheet according to claim 1, further comprising:

elements of group(s) of one type or two types or more selected from:

a first group of one type or two types selected from a group consisting of Cu: 0.5 mass % or less, and Cr: 20 mass % or less;

a second group of one type or two types selected from a group consisting of Sn and Sb for a total of 0.3 mass % or less;

a third group of Ni: 1.0 mass % or less, and a fourth group of Ca: 0.01 mass % or less.

* * * * *